US010424178B2

(12) United States Patent
Thalhofer

(10) Patent No.: US 10,424,178 B2
(45) Date of Patent: Sep. 24, 2019

(54) CHILD SAFETY ASSEMBLY

(71) Applicant: Alicia Thalhofer, Altus, OK (US)

(72) Inventor: Alicia Thalhofer, Altus, OK (US)

( * ) Notice: Subject to any disclaimer, the term of this patent is extended or adjusted under 35 U.S.C. 154(b) by 26 days.

(21) Appl. No.: 15/801,396

(22) Filed: Nov. 2, 2017

(65) Prior Publication Data

US 2019/0130722 A1 May 2, 2019

(51) Int. Cl.

| | |
|---|---|
| ***G08B 21/02*** | (2006.01) |
| ***G08B 21/04*** | (2006.01) |
| ***G08B 23/00*** | (2006.01) |
| ***A44C 5/20*** | (2006.01) |

(52) U.S. Cl.

CPC ..... *G08B 21/0294* (2013.01); *A44C 5/2033* (2013.01); *A44C 5/2038* (2013.01); *A44C 5/2057* (2013.01); *A44C 5/2071* (2013.01); *G08B 21/0202* (2013.01); *G08B 21/0263* (2013.01); *G08B 21/0288* (2013.01); *G08B 21/0469* (2013.01); *G08B 23/00* (2013.01)

(58) Field of Classification Search

CPC ..... G08B 21/0202; G08B 21/0211; G08B 21/0219; G08B 21/0225; G08B 21/0252; G08B 21/0255; G08B 21/0258; G08B 21/0286; G08B 21/0288; G08B 21/0291; G08B 21/0294; G08B 21/0438; G08B 21/0453; G08B 21/0469

See application file for complete search history.

(56) References Cited

U.S. PATENT DOCUMENTS

| | | | | |
|---|---|---|---|---|
| 5,900,817 | A | 5/1999 | Olmassakian | |
| 6,239,715 | B1 * | 5/2001 | Belton | G08B 21/0216 340/471 |
| 6,470,708 | B1 * | 10/2002 | Green | A44C 5/2071 24/116 A |
| 7,511,627 | B2 | 3/2009 | Holoyda | |
| 7,602,303 | B2 | 10/2009 | Douglas et al. | |
| 8,698,623 | B1 | 4/2014 | Hicks | |
| 9,251,686 | B1 | 2/2016 | Reich et al. | |
| 2007/0247307 | A1 | 10/2007 | Riep | |
| 2008/0159085 | A1 * | 7/2008 | Hozumi | A44C 5/14 368/282 |
| 2015/0107126 | A1 | 4/2015 | Sluder, III | |

(Continued)

FOREIGN PATENT DOCUMENTS

WO WO2016196665 12/2016

*Primary Examiner* — Laura N Nguyen

(57) ABSTRACT

A child safety assembly includes a wristband that is selectively worn around a child's wrist. A lock is movably coupled to the wristband and the lock is selectively manipulated. The lock is selectively positioned in a locked position to retain the wristband on the wrist. The lock is selectively positioned in an unlocked position to facilitate the wristband to be removed from the wrist. An alert unit is coupled to the wristband and the alert unit is in thermal communication with the wristband's environment. The alert unit selectively emits an audible alarm and the alert unit is in wireless electrical communication with an electronic device. The alert unit emits the audible alarm when the alert unit detects a temperature of the wristband's environment falls below or rises above a trigger temperature. In this way the alert unit alerts a caregiver to a potential hazard with respect to the child.

12 Claims, 4 Drawing Sheets

(56) References Cited

U.S. PATENT DOCUMENTS

| | | | | |
|---|---|---|---|---|
| 2015/0201846 | A1* | 7/2015 | Maiershon | A61B 5/0205 600/301 |
| 2017/0035367 | A1* | 2/2017 | Reich | A61B 5/1112 |

* cited by examiner

CHILD SAFETY ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to safety devices and more particularly pertains to a new safety device for generating an alarm when a child is exposed to an environmental hazard.

BRIEF SUMMARY OF THE INVENTION

An embodiment of the disclosure meets the needs presented above by generally comprising a wristband that is selectively worn around the wrist of a child.

A lock is movably coupled to the wristband and the lock is selectively manipulated. The lock is selectively positioned in a locked position to retain the wristband on the wrist. The lock is selectively positioned in an unlocked position to facilitate the wristband to be removed from the wrist. An alert unit is coupled to the wristband and the alert unit is in thermal communication with the wristband's environment. The alert unit selectively emits an audible alarm and the alert unit is in wireless electrical communication with an electronic device. The alert unit emits the audible alarm when the alert unit detects a temperature of the wristband's environment falls below or rises above a trigger temperature. In this way the alert unit alerts a caregiver to a potential hazard with respect to the child.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
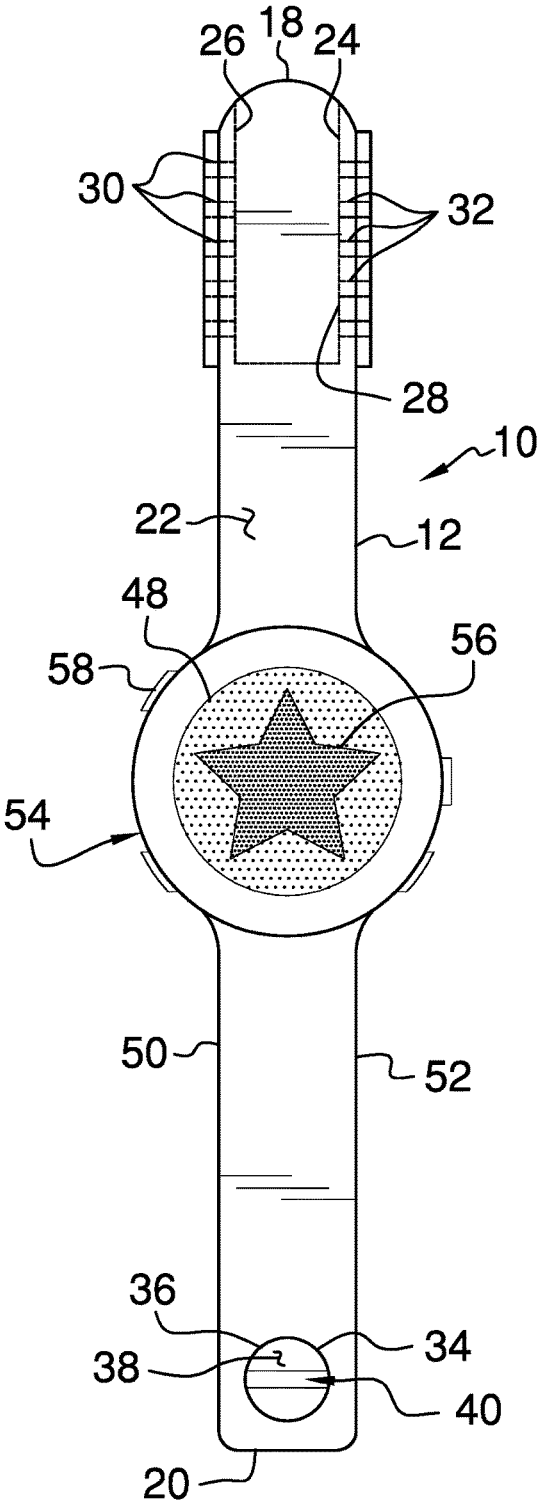
FIG. 1 is a top view of a child safety assembly according to an embodiment of the disclosure.
Figure 2:
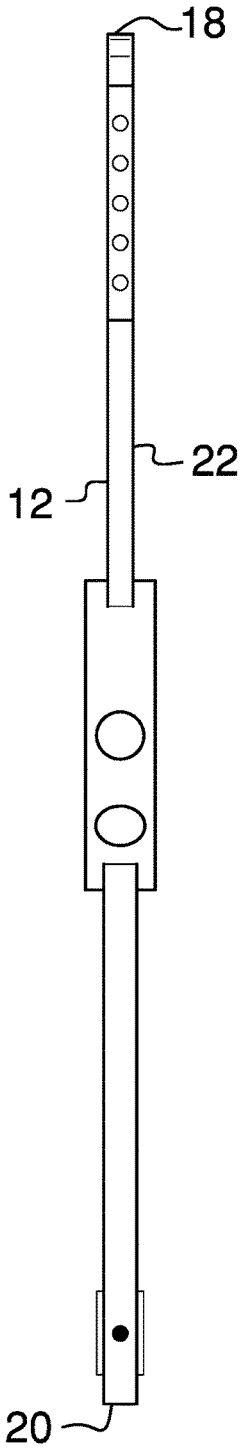
FIG. 2 is a right side view of an embodiment of the disclosure.
Figure 3:
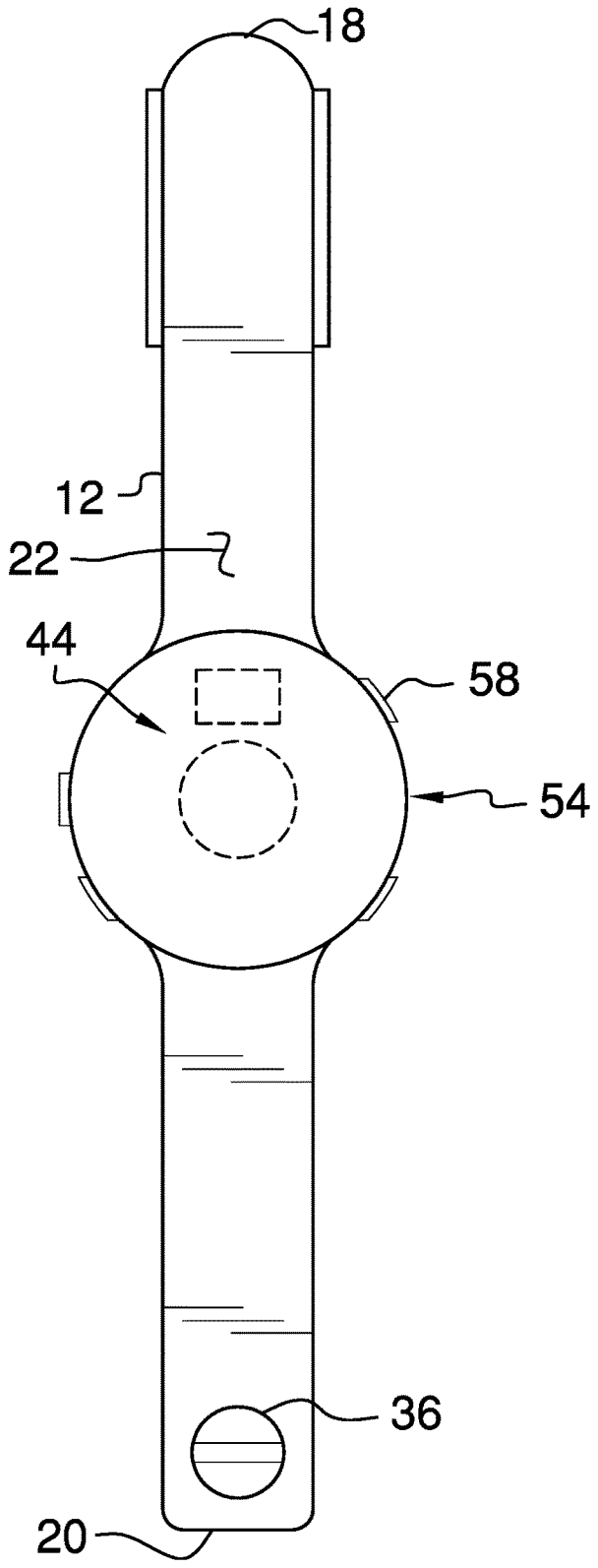
FIG. 3 is a bottom phantom view of an embodiment of the disclosure.
Figure 4:
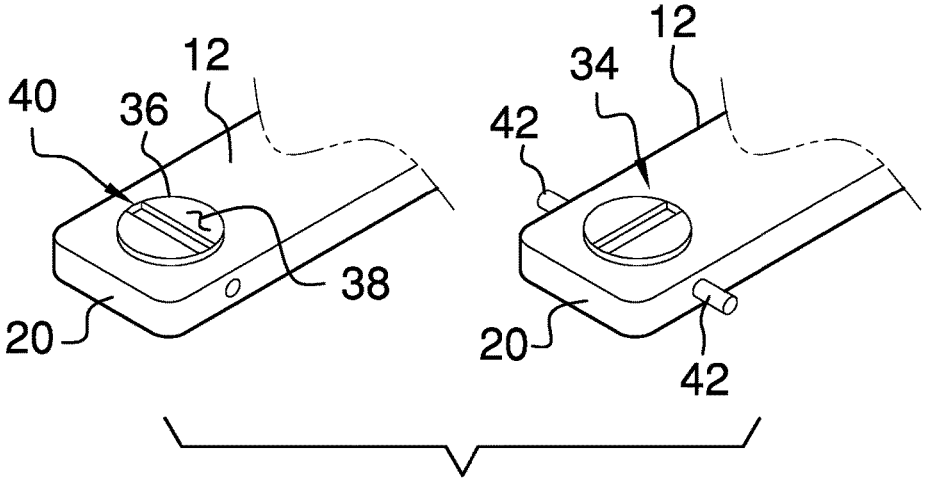
FIG. 4 is a perspective view of lock of an embodiment of the disclosure.
Figure 5:
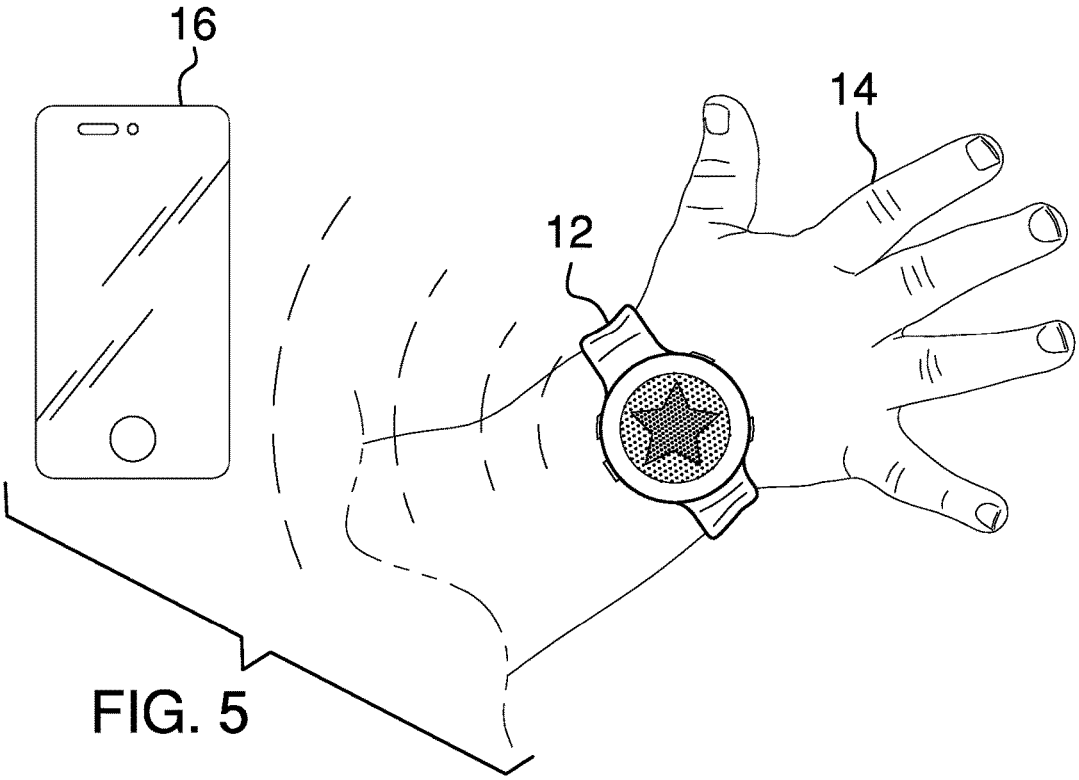
FIG. 5 is a perspective in-use view of an embodiment of the disclosure.
Figure 6:
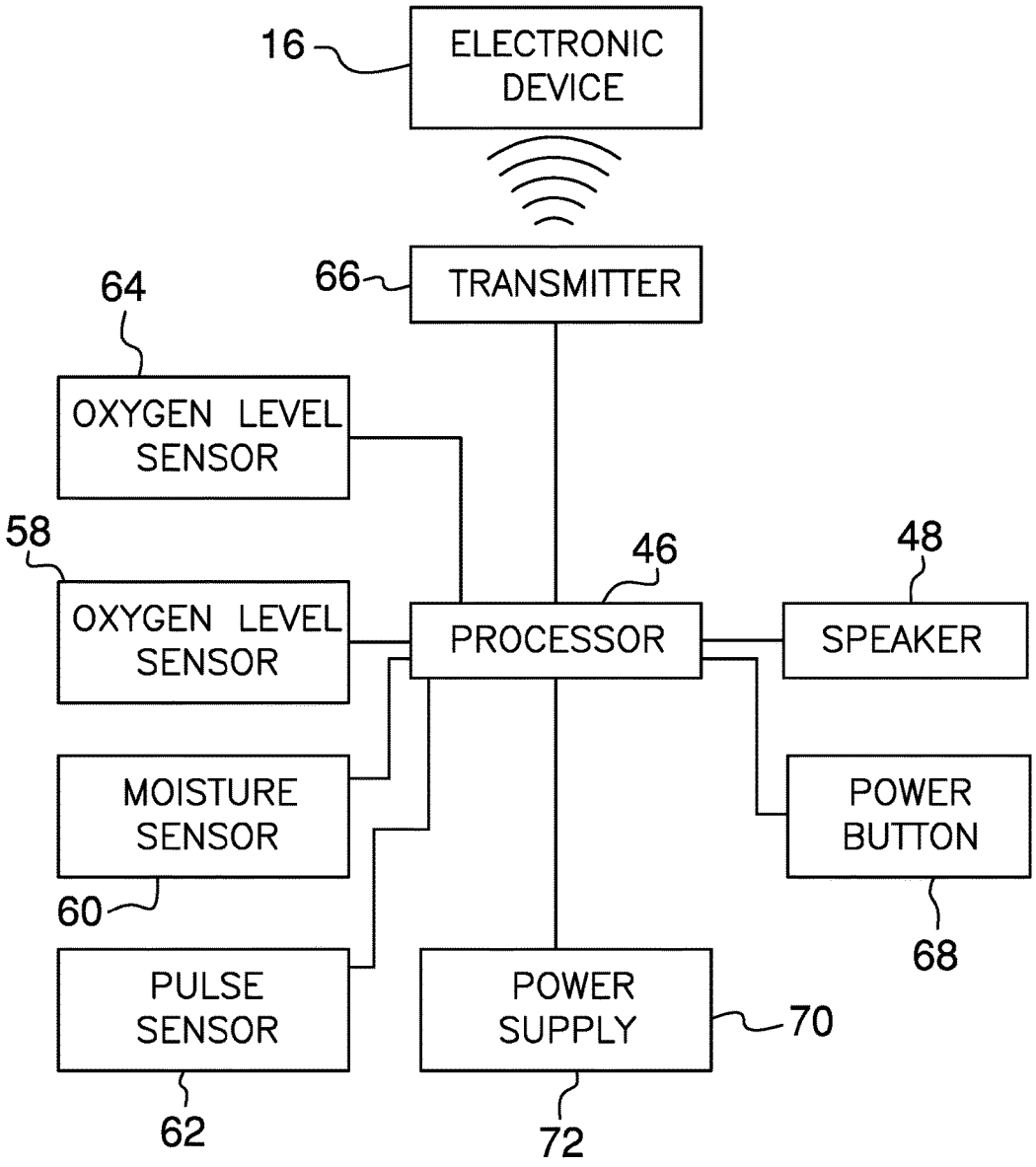
FIG. 6 is a schematic view of an embodiment of the disclosure.

With reference now to the drawings, and in particular to FIGS. 1 through 6 thereof, a new safety device embodying the principles and concepts of an embodiment of the disclosure and generally designated by the reference numeral 10 will be described.

As best illustrated in FIGS. 1 through 6, the child safety assembly 10 generally comprises a wristband 12 that may be worn around the wrist of a child 14. The child 14 may be attending a pool, a party and any other location involving the potential for the child 14 to be inadvertently unsupervised. The child 14 may have a caregiver and the caregiver may be a parent or the child 14 or the like. Additionally, the caregiver may be carrying an electronic device 16 with wireless communication capabilities such as a smart phone or the like.

The wristband 12 has a first end 18, a second end 20 and an outer surface 22 extending therebetween. The first end 18 has a first well 24 extending toward the second end 20 and the first well 24 has a first lateral bounding surface 26 and a second lateral bonding surface. The first well 24 insertably receives the second end 20 when the wristband 12 is worn around the wrist. Thus, the wristband 12 forms a closed loop to be retained on the wrist.

The first lateral bounding surface 26 has a plurality of second wells 30 extending outwardly therein. The second wells 30 are spaced apart from each other and are distributed along the first lateral bounding surface 26. The second lateral bounding surface 28 has a plurality of third wells 32 extending outwardly therein. The third wells 32 are spaced apart from each other and are distributed along the second lateral bounding surface 28.

A lock 34 is movably coupled to the wristband 12 and the lock 34 is selectively manipulated. The lock 34 is selectively positioned in a locked position to retain the wristband 12 on the wrist. Additionally, the lock 34 is selectively positioned in an unlocked position to facilitate the wristband 12 to be removed from the wrist. The lock 34 comprises a knob 36 that is rotatably coupled to the wristband 12 and the knob 36 is selectively rotated in a first direction and a second direction. The knob 36 has a first surface 38 and the first surface 38 has a groove 40 therein. The groove 40 may be engaged by a coin or the like for rotating the knob 36. Additionally, the knob 36 may have a frictional resistance to rotation that inhibits the child 14's ability to rotate the knob 36 and potentially remove the wristband 12.

The lock 34 includes a pair of pegs 42 and each of the pegs 42 is slidably coupled to the wristband 12. Each of the pegs 42 is in mechanical communication with the knob 36 and each of the pegs 42 extends outwardly from the wristband 12 when the knob 36 is rotated in the first direction. Moreover, each of the pegs 42 engages a selected one of the second wells 30 and the third wells 32 when the knob 36 is rotated in the first direction and the second end 20 of the wristband 12 is inserted into the first well 24. In this way the pegs 42 lock the wristband 12 on the wrist of the child 14. Each of the pegs 42 is recessed into the wristband 12 when the knob 36 is rotated in the second direction. Moreover, each of the pegs 42 disengages from the wristband 12 when the knob 36 is rotated in the second direction. Thus, each of the pegs 42 facilitates the wristband 12 to be removed from the wrist of the child 14.

An alert unit 44 is coupled to the wristband 12 and the alert unit 44 is in thermal communication with the wristband 12's environment. The alert unit 44 selectively emits an audible alarm and the alert unit 44 is in wireless electrical communication with the electronic device 16 carried by the caregiver. The alert unit 44 emits the audible alarm when the alert unit 44 detects a temperature of the wristband's 12 environment falls below or rises above a trigger temperature. In this way the alert unit 44 alerts a caregiver, and any other individuals near the child 14, to a potential hazard with respect to the child 14.

The alert unit 44 comprises a processor 46 that is positioned within the wristband 12 and the processor 46 selectively generates an alarm sequence. Additionally, the processor 46 may be an electronic processor 46 and the processor 46 may include an electronic memory. The electronic memory may store data pertaining to a trigger temperature. A speaker 48 is coupled to the wristband 12 to selectively emit audible sounds outwardly from the wristband 12. The speaker 48 is electrically coupled to the processor 46 and the speaker 48 emits the audible alarm when the processor 46 generates set alarm sequence. The speaker 48 may be an electronic speaker 48 or the like.

The wristband 12 has a first side 50 and a second side 52. Each of the first side 50 and the second side 52 may curve outwardly near a middle of the wristband 12 to define a round portion 54 of the wristband 12. Thus, the wristband 12 may have the appearance of a wrist watch. The speaker 48 may be positioned on the round portion 54 of the wristband 12. Additionally, indicia 56 may be printed on the round portion 54 and the indicia 56 may comprise an image of a star, a geometric shape and any other ornamental image.

A temperature sensor 58 is coupled to the wristband 12 to detect ambient temperature with respect to the wristband 12. The temperature sensor 58 is electrically coupled to the processor 46 and the processor 46 generates the alarm sequence when the temperature sensor 58 detects the ambient temperature falls below or rises above a predetermined trigger temperature. The trigger temperature may be a temperature ranging between approximately 60.0° F. and 80.0° F. In this way the temperature sensor 58 facilitates the caregiver to be notified if the child 14 is exposed to a dangerous temperature, such as the interior of a car or the like. The temperature sensor 58 may be an electronic temperature sensor 58 of any conventional design.

A moisture sensor 60 is coupled the wristband 12 detect moisture and the moisture sensor 60 is electrically coupled to the processor 46. The processor 46 generates the alarm sequence when the moisture sensor 60 detects moisture. The moisture sensor 60 may be an electronic water sensor or the like. Additionally, the moisture sensor 60 may detect when the child 14 falls into a pool or other body of water. Thus the caregiver is notified when the child 14 is exposed to a potential drowning hazard.

A pulse sensor 62 is coupled to the wristband 12 to detect a pulse of the child 14 and the pulse sensor 62 is electrically coupled to the processor 46. The processor 46 generates the alarm sequence when the pulse sensor 62 detects the child 14's pulse falls below a predetermined trigger pulse. The pulse sensor 62 may be an electronic pulse sensor 62 of any conventional design. Additionally, the pulse sensor 62 may detect when the child 14 has experienced a cardiac event, or any other traumatic event that inhibits the child 14's heartbeat.

An oxygen level sensor 64 is coupled the wristband 12 to detect a level of oxygen in the child 14 and the oxygen level sensor 64 is electrically coupled the processor 46. The processor 46 generates the alarm sequence when the oxygen level sensor 64 detects the level of oxygen in the child 14 falls below a predetermined trigger level. The oxygen level sensor 64 may be an electronic blood oxygen saturation sensor or the like. Additionally, the oxygen level sensor 64 may notify the caregiver when the child 14 is having difficulty breathing.

A transmitter 66 is coupled the wristband 12 and the transmitter 66 is in wireless electrical communication with the electronic device 16. The transmitter 66 is electrically coupled to the processor 46 and the transmitter 66 transmits an alert to the electronic device 16 when the processor 46 generates set alarm sequence. The transmitter 66 may be a radio frequency transmitter 66 or the like. Additionally, the transmitter 66 may employ a WPAN signal and the transmitter 66 may employ Bluetooth communication protocols. In this way the transmitter 66 may be synced with the electronic device 16 in the convention of Bluetooth.

A power button 68 is coupled the wristband 12 and the power button 68 is electrically coupled the processor 46 to turn the processor 46 on and off. A power supply 70 is positioned within the wristband 12 and the power supply 70 is electrically coupled to the processor 46. The power supply 70 comprises at least one battery 72.

In use, the wristband 12 is worn on the child 14's wrist when the child 14 is at a public location, such as a swimming pool or the like, where the child 14 could potentially become unsupervised. The processor 46 generates the alarm sequence to notify the caregiver of a potentially dangerous temperature, a potential cardiac emergency, a potential breathing emergency and a potential drowning emergency. Additionally, the speaker 48 emits the audible alarm when the processor 46 generates the alarm sequence to notify bystanders of the potential emergency. In this way the child 14 is protected against any conceivable emergency.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A child safety assembly being configured to be worn on a child thereby facilitating an alert to be generated when the child is exposed to a hazard, said assembly comprising:

a wristband being configured to be worn around the wrist of a child, said wristband having a first end, a second end and an outer surface extending therebetween, said first end having a first well extending toward said second end, said first well having a first lateral bounding surface and a second lateral bonding surface, said first well insertably receiving said second end when said wristband is worn around the wrist such that said wristband forms a closed loop wherein said wristband is configured to be retained on the wrist, said first lateral bounding surface having a plurality of second wells extending outwardly therein, said second wells being spaced apart from each other and being distributed along said first lateral bounding surface, said second lateral bounding surface having a plurality of third wells extending outwardly therein, said third wells being spaced apart from each other and being distributed along said second lateral bounding surface;

a lock being movably coupled to said wristband wherein said lock is configured to be manipulated, said lock being selectively positioned in a locked position to retain said wristband on the wrist, said lock being selectively positioned in an unlocked position to facilitate said wristband to be removed from the wrist, said lock comprising a knob being rotatably coupled to said wristband wherein said knob is configured to be selectively rotated in a first direction and a second direction, and a pair of pegs, each of said pegs being slidably coupled to said wristband, each of said pegs being in mechanical communication with said knob, each of said pegs extending outwardly from said wristband when said knob is rotated in said first direction, each of said pegs engaging a selected one of said second wells and said third wells when said knob is rotated in said first direction and said second end of said wristband is inserted into said first well wherein each of said pegs is configured to lock said wristband on the wrist of the child; and an alert unit being coupled to said wristband wherein said alert unit is configured to be in thermal communication with said wristband's environment, said alert unit selectively emitting an audible alarm, said alert unit being configured to be in wireless electrical communication with an electronic device, said alert unit emitting said audible alarm when said alert unit detects a temperature of said wristband's environment falls below or rises above a trigger temperature wherein said alert unit is configured to alert a caregiver to a potential hazard with respect to the child.

2. The assembly according to claim 1, wherein each of said pegs is recessed into said wristband wherein said knob is rotated in said second direction, each of said pegs disengaging from said wristband when said knob is rotated in said second direction wherein each of said pegs is configured to facilitate the wristband to be removed from the wrist of the child.

3. The assembly according to claim 1, further comprising said alert unit comprises a processor being positioned within said wristband, said processor selectively generating an alarm sequence.

4. The assembly according to claim 3, further comprising a speaker being coupled to said wristband wherein said speaker is configured to selectively emit audible sounds outwardly from said wristband, said speaker being electrically coupled to said processor, said speaker emitting said audible alarm when said processor generates set alarm sequence.

5. The assembly according to claim 3, further comprising a temperature sensor being coupled to said wristband wherein said temperature sensor is configured to detect ambient temperature with respect to said wristband, said temperature sensor being electrically coupled to said processor, said processor generating said alarm sequence when said temperature sensor detects the ambient temperature falls below or rises above a predetermined trigger temperature.

6. The assembly according to claim 3, further comprising a moisture sensor being coupled said wristband wherein said moisture sensor is configured to detect moisture, said moisture sensor being electrically coupled to said processor, said processor generating said alarm sequence when said moisture sensor detects moisture.

7. The assembly according to claim 3, further comprising a pulse sensor being coupled to said wristband wherein said pulse sensor is configured to detect a pulse of the child, said pulse sensor being electrically coupled to said processor, said processor generating said alarm sequence when said pulse sensor detects the child's pulse falls below a predetermined trigger pulse.

8. The assembly according to claim 3, further comprising an oxygen level sensor being coupled said wristband wherein said oxygen level sensor is configured to detect a level of oxygen in the child, said oxygen level sensor being electrically coupled said processor, said processor generating said alarm sequence when said oxygen level sensor detects the level of oxygen in the child falls below a predetermined trigger level.

9. The assembly according to claim 3, further comprising a transmitter being coupled said wristband wherein said transmitter is configured to be in wireless electrical communication with the electronic device, said transmitter being electrically coupled to said processor, said transmitter transmitting an alert to the electronic device when said processor generates set alarm sequence.

10. The assembly according to claim 3, further comprising a power button being coupled said wristband where in said power button is configured to be manipulated, said power button being electrically coupled said processor such that said power button turn said processor on and off.

11. The assembly according to claim 3, further comprising a power supply being positioned within said wristband, said power supply being electrically coupled to said processor, said power supply comprising at least one battery.

12. A child safety assembly being configured to be worn on a child thereby facilitating an alert to be generated when the child is exposed to a hazard, said assembly comprising:

a wristband being configured to be worn around the wrist of a child, said wristband having a first end, a second end and an outer surface extending therebetween, said first and having a first well extending toward said second end, said first well having a first lateral bounding surface and a second lateral bonding surface, said first well insertably receiving said second end when said wristband is worn around the wrist such that said wristband forms a closed loop wherein said wristband is configured to be retained on the wrist, said first lateral bounding surface having a plurality of second wells extending outwardly therein, said second wells being spaced apart from each other and being distributed along said first lateral bounding surface, said second lateral bounding surface having a plurality of third wells extending outwardly therein, said third wells being spaced apart from each other and being distributed along said second lateral bounding surface;

a lock being movably coupled to said wristband wherein said lock is configured to be manipulated, said lock being selectively positioned in a locked position to retain said wristband on the wrist, said lock being selectively positioned in an unlocked position to facilitate said wristband to be removed from the wrist, said lock comprising:

a knob being rotatably coupled to said wristband wherein said knob is configured to be selectively rotated in a first direction and a second direction, a pair of pegs, each of said pegs being slidably coupled to said wristband, each of said pegs being in mechanical communication with said knob, each of said pegs extending outwardly from said wristband when said knob is rotated in said first direction, each of said pegs engaging a selected one of said second wells and said third wells when said knob is rotated in said first direction and said second end of said wristband is inserted into said first well wherein each of said pegs is configured to lock said wristband on the wrist of the child, each of said pegs being recessed into said wristband wherein said knob is rotated in said second direction, each of said pegs disengaging from said wristband when said knob is rotated in said second direction wherein each of said pegs is configured to facilitate the wristband to be removed from the wrist of the child; and an alert unit being coupled to said wristband wherein said alert unit is configured to be in thermal communication with said wristband's environment, said alert unit selectively emitting an audible alarm, said alert unit being configured to be in wireless electrical communication with an electronic device, said alert unit emitting said audible alarm when said alert unit detects a temperature of said wristband's environment falls below or rises above a trigger temperature wherein said alert unit is configured to alert a caregiver to a potential hazard with respect to the child, said alert unit comprising:

a processor being positioned within said wristband, said processor selectively generating an alarm sequence, a speaker being coupled to said wristband wherein said speaker is configured to selectively emit audible sounds outwardly from said wristband, said speaker being electrically coupled to said processor, said speaker emitting said audible alarm when said processor generates set alarm sequence, a temperature sensor being coupled to said wristband wherein said temperature sensor is configured to detect ambient temperature with respect to said wristband, said temperature sensor being electrically coupled to said processor, said processor generating said alarm sequence when said temperature sensor detects the ambient temperature falls below or rises above a predetermined trigger temperature, a moisture sensor being coupled said wristband wherein said moisture sensor is configured to detect moisture, said moisture sensor being electrically coupled to said processor, said processor generating said alarm sequence when said moisture sensor detects moisture, a pulse sensor being coupled to said wristband wherein said pulse sensor is configured to detect a pulse of the child, said pulse sensor being electrically coupled to said processor, said processor generating said alarm sequence when said pulse sensor detects the child's pulse falls below a predetermined trigger pulse, an oxygen level sensor being coupled said wristband wherein said oxygen level sensor is configured to detect a level of oxygen in the child, said oxygen level sensor being electrically coupled said processor, said processor generating said alarm sequence when said oxygen level sensor detects the level of oxygen in the child falls below a predetermined trigger level, a transmitter being coupled said wristband wherein said transmitter is configured to be in wireless electrical communication with the electronic device, said transmitter being electrically coupled to said processor, said transmitter transmitting an alert to the electronic device when said processor generates set alarm sequence, a power button being coupled said wristband where in said power button is configured to be manipulated, said power button being electrically coupled said processor such that said power button turn said processor on and off, and a power supply being positioned within said wristband, said power supply being electrically coupled to said processor, said power supply comprising at least one battery.

* * * * *